US005492148A

United States Patent [19]

Goughneour et al.

[11] Patent Number: 5,492,148

[45] Date of Patent: Feb. 20, 1996

[54] RINSING ASSEMBLY WITH SWIVEL ACTUATING VALVE

[75] Inventors: Richard J. Goughneour, Travelers Rest; Michael Regelbrugge, Fountian Inn; Craig Ashton, Greer, all of S.C.

[73] Assignee: T&S Brass and Bronze Works, Inc., Travelers Rest, S.C.

[21] Appl. No.: 282,804

[22] Filed: Jul. 29, 1994

[51] Int. Cl.[6] ..... E03B 1/00

[52] U.S. Cl. ..... 137/616.5; 251/347; 251/348

[58] Field of Search ..... 137/615, 616.5; 251/347, 348

[56] References Cited

U.S. PATENT DOCUMENTS

| | | | |
|---|---|---|---|
| 980,353 | 1/1911 | Smith | 137/616.5 |
| 1,535,254 | 4/1925 | Russell | 137/616.5 |
| 1,621,905 | 3/1927 | Russell | 137/616.5 |
| 1,709,245 | 4/1929 | Adams | 137/616.5 |
| 2,492,049 | 12/1949 | Krone et al. | 137/615 |
| 3,099,297 | 7/1963 | Knight | 137/616.5 |
| 3,451,628 | 6/1969 | Kelley | 137/616 |
| 4,709,715 | 12/1987 | Knight | 137/616.5 |

OTHER PUBLICATIONS

Appropriate Pages from the T&S Brass and Bronze Works, Inc. General Catalog, Feb. 1992.

*Primary Examiner*—A. Michael Chambers
*Attorney, Agent, or Firm*—Dority & Manning

[57] ABSTRACT

A rinsing assembly has a swivel actuation valve disposed between a riser pipe member and second pipe member. The swivel actuation valve has an inner body member disposed co-axially within an outer body member. The outer body member is axially movable relative to the inner body member. A sealable internal fluid path is defined through the inner body member and the outer body member. The fluid path is sealed when the body members are in a first relative axial position and is open when the body members are in a second relative axial position. Internal biasing means bias the inner and outer body members towards the first relative axial position.

23 Claims, 4 Drawing Sheets

RINSING ASSEMBLY WITH SWIVEL ACTUATING VALVE

BACKGROUND OF THE INVENTION

The present invention relates to a pull-down actuated fluid conducting assembly, and in more particular to a rinsing unit incorporating an inventive swivel joint actuating valve.

Rinsing units, or pull-type pre-rinse assemblies, are well known in the art. For example, a common use of an exemplary device is in food services and hospital environments. An example of such a pre-rinse assembly is the "Nautilus" pre-rinse assembly from T&S Brass and Bronze Works, Inc. of Traveler's Rest, S.C. These units consist essentially of articulatable fluid conducting arm members with an attached hose or like device having a spray nozzle. The arm members are joined by swivel joints or knuckles which are designed to provide the widest possible area coverage while placing minimum stress on the hose or arm members.

One type of conventional pre-rinse unit is actuated by an operator pulling down on the spray head or nozzle assembly. This type of assembly differs from other well known pre-rinse units wherein the device is actuated by a spray handle or lever operably configured with the spray head or nozzle. With the conventional pull-down actuation type of assembly, a separate swivel mechanism is incorporated to allow the upper or intermediate arm assembly to rotate about the riser pipe. A separate actuation valve was also incorporated in the device and is actuated by a linkage arm which typically actuates a one-quarter turn ball valve to turn on the flow of water when the upper arm assembly is pulled down by the operator. An example of this type of configuration is the "Nautilus #2" pre-rinse assembly (B-136) also by T&S Brass and Bronze Works, Inc.

Problems have existed in the field with the conventional pull-down actuation unit described above. For example, the linkage mechanism required to actuate the ball valve is relatively complicated and cumbersome and requires relatively frequent maintenance and alignment. Also, the linkage causes spacing and clearance problems when the pre-rinse unit was used in a relatively confined area. Additionally, after a period of use, the conventional ball valves tend to develop leaks and require replacement or maintenance. These problems have reduced the overall reliability of the pre-rinse units, and could result in a dangerous condition if the pre-rinse unit is used to conduct, for example, relatively hot water. Failure of any of these components is relatively expensive in that the entire assembly generally must be disassembled in order to replace the linkage assembly or ball valve due to the relatively complicated mechanical configuration of the components.

With the present invention, applicant provides an improved swivel joint actuation device for use in any manner of fixtures including rinsing units. The improved swivel actuation device has a significantly longer life than its conventional counter-part mechanisms and generally eliminates the problems with the conventional devices discussed above.

OBJECTS AND SUMMARY OF THE INVENTION

A principle object of the present invention is to provide an improved swivel actuation device for use in any manner of fluid conducting fixtures, including rinsing assemblies.

Another object of the present invention is to provide an improved rinsing unit.

Still a further object of the present invention is to provide an improved swivel actuation device for use in pull down pre-rinse units which increases the reliability and decreases the mechanical complexity of the units.

And still a further object of the present invention is to provide an improved swivel actuation device which can be retro-fitted into conventional pre-rinse units.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purposes of the invention, as embodied and broadly described herein, a swivel actuation valve is provided for use with a pull-down actuated rinsing assembly. The rinsing assembly, or pre-rinse unit, may be a conventional type unit such as the "Nautilus #2" assembly by T & S Brass and Bronze Works, Inc. The actuation valve includes an outer sleeve member which defines an internal cavity and an outlet in fluid communication with the cavity. The outlet is mateable with a fluid conducting arm of the rinsing assembly, for example through threaded engagement therewith. An inner fluid conducting member is disposed substantially within the internal cavity and coaxial with the outer sleeve member. The inner fluid conducting member may have an inlet end which is mateable with another fluid conducting arm of the rinsing assembly or may comprise a section of the riser pipe itself, and a discharge end which is open to the internal cavity of the outer sleeve member. The outer sleeve member is axially moveable relative to the inner sleeve member between a closed relative position and an open relative position. In the open relative position, an internal fluid path is defined between the discharge end of the inner fluid conducting member and the outlet of the outer sleeve member. First bearing means are preferably provided disposed between the outer sleeve member and the inner fluid conducting member so that the members can rotate relative each other. A first sealing means is disposed between the outer sleeve member and the inner fluid conducting member for sealing the internal fluid path in the closed relative position of the outer sleeve member and inner fluid conducting member.

The actuation valve further includes resilient biasing means which are disposed relative to the outer sleeve member and the inner fluid conducting member for biasing the outer sleeve member to the closed position wherein the internal fluid path is sealed.

The actuation valve may further include an end cap which is releasably engaged with the outer sleeve member so as rotate therewith relative to the inner fluid conducting member. In this embodiment, a second bearing means may be provided disposed between the end cap and the inner fluid conducting member for allowing relative rotational movement therebetween. With this embodiment, a second sealing means may be disposed between a threaded extension of the end cap and the inner fluid conducting member for preventing leakage of fluid from the internal cavity. It is preferred that the first sealing means and second sealing means comprise generally equal surfaces area presented to pressurized fluid within the internal cavity so that the pressurized fluid will not bind axial movement between the outer sleeve member and the inner fluid conducting member.

In a preferred embodiment of the invention, the resilient biasing means comprises a spring disposed between the outer sleeve member and the inner fluid conducting member. This spring is preferably pre-stressed so as to axially force apart the outer sleeve member to the closed position relative to the inner fluid conducting member. The spring is preferably pre-stressed between a stop which is secured relative to the inner fluid member and a spring seat which is secured relative to the outer sleeve member.

In another preferred embodiment of the invention, the discharge of the inner fluid conducting member, which is open to the internal cavity of the outer conducting member, includes at least one fluid discharge port which is oriented substantially perpendicular to the axis of the inner fluid conducting member. Preferably, two or more such ports are included. With this embodiment, it is also preferred that the outer sleeve member internal cavity include a first section having a first inner diameter and a second section having a second inner diameter which is greater than the first inner diameter. The first sealing means comprises a resilient sealing ring, such as an O-ring, disposed about the inner fluid conducting member which seals against the inner diameter of the internal cavity first section in the closed relative position of the members while the discharge port is open to the second section. With this arrangement, the internal fluid path is defined or opened when the resilient sealing ring is axially displaced to the second section by movement of the inner fluid conducting member relative to the outer sleeve member. This embodiment may also preferably include a third section of the internal cavity having a third inner diameter which is greater than the second inner diameter. With this embodiment, the resilient biasing means may comprise a spring which is disposed within the third section.

The bearing devices according to the present invention may include any manner of conventional bearings, such as Teflon O-rings or bands, ball bearings, or any other suitable bearing means. Preferably, the actuation valve is formed of brass or other desirable material for use in such an application, and the bearing means and sealing means are configured so that there is no brass-to brass contact. This arrangement prevents galling of components and minimizes wear of critical parts. The actuation valve according to the invention is easily removable from the rinsing assembly and readily disassembled for replacement of wear parts, such as the bearing means and sealing means. Thus, the present actuation valve can be also retro-fitted into existing rinsing assemblies.

To further achieve the objects and in accordance with the present invention, a rinsing assembly is provided having a riser pipe member which is connectable to a fluid source. A second pipe member is articulately configured in fluid communication with the riser pipe member. The second pipe member is also pivotal relative to the riser pipe member. A pivotable fluid conducting knuckle is disposed between the riser pipe member and the second pipe member. The rinsing assembly also includes a swivel actuation valve operably disposed between the riser pipe member and the second pipe member. In a preferred embodiment, the swivel actuation valve is disposed with one end thereof connected to the riser pipe section, or may comprise a section of the riser pipe itself, and the other end thereof connected to the pivotable conducting knuckle. The swivel actuation valve of the inventive rinsing assembly is in accordance to the swivel actuation valve discussed above.

In a preferred embodiment of the rinsing assembly, a third pipe member is provided articulately configured in fluid communication with the second pipe member. Preferably, a spray head is operably configured with the third pipe member. The spray head includes a gripping portion whereby an operator can actuate the rinsing assembly by grasping the gripping portion and pulling the third pipe member downward. Preferably, the third pipe member comprises a flexible hose.

The accompanying drawings, which are incorporated and constitute a part of this specification, illustrate preferred embodiments of the invention and, together with the description, serve to explain the principles of the invention.

DETAILED DESCRIPTION OF THE PREFERRED EMBODIMENTS

Figure 1:
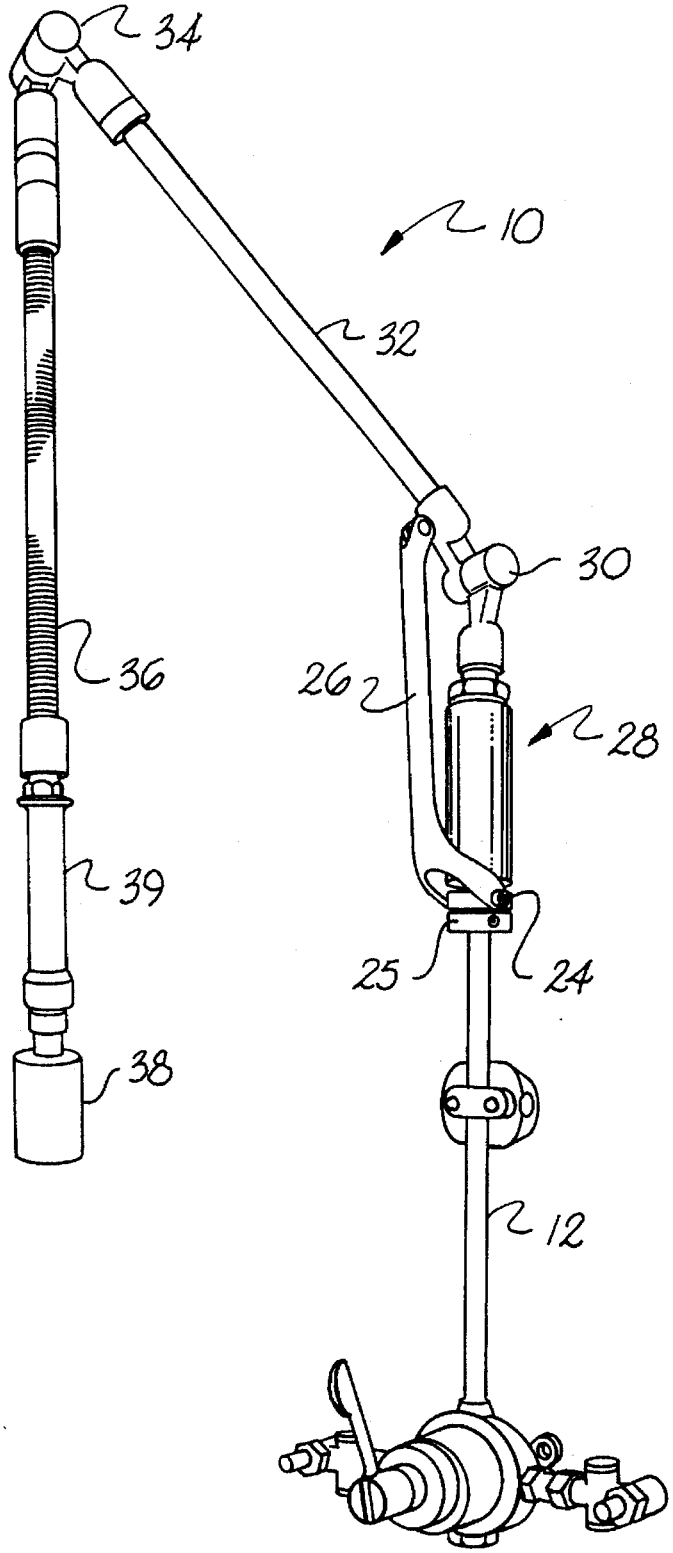
FIG. 1 is a view of a fully assembled rinsing assembly according to the present invention which incorporates the inventive swivel actuation valve.

Reference now will be made in detail to the presently preferred embodiments of the invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. The numbering of components in the drawings is consistent throughout the application, with the same components having the same number in each of the drawings.

Figure 2:
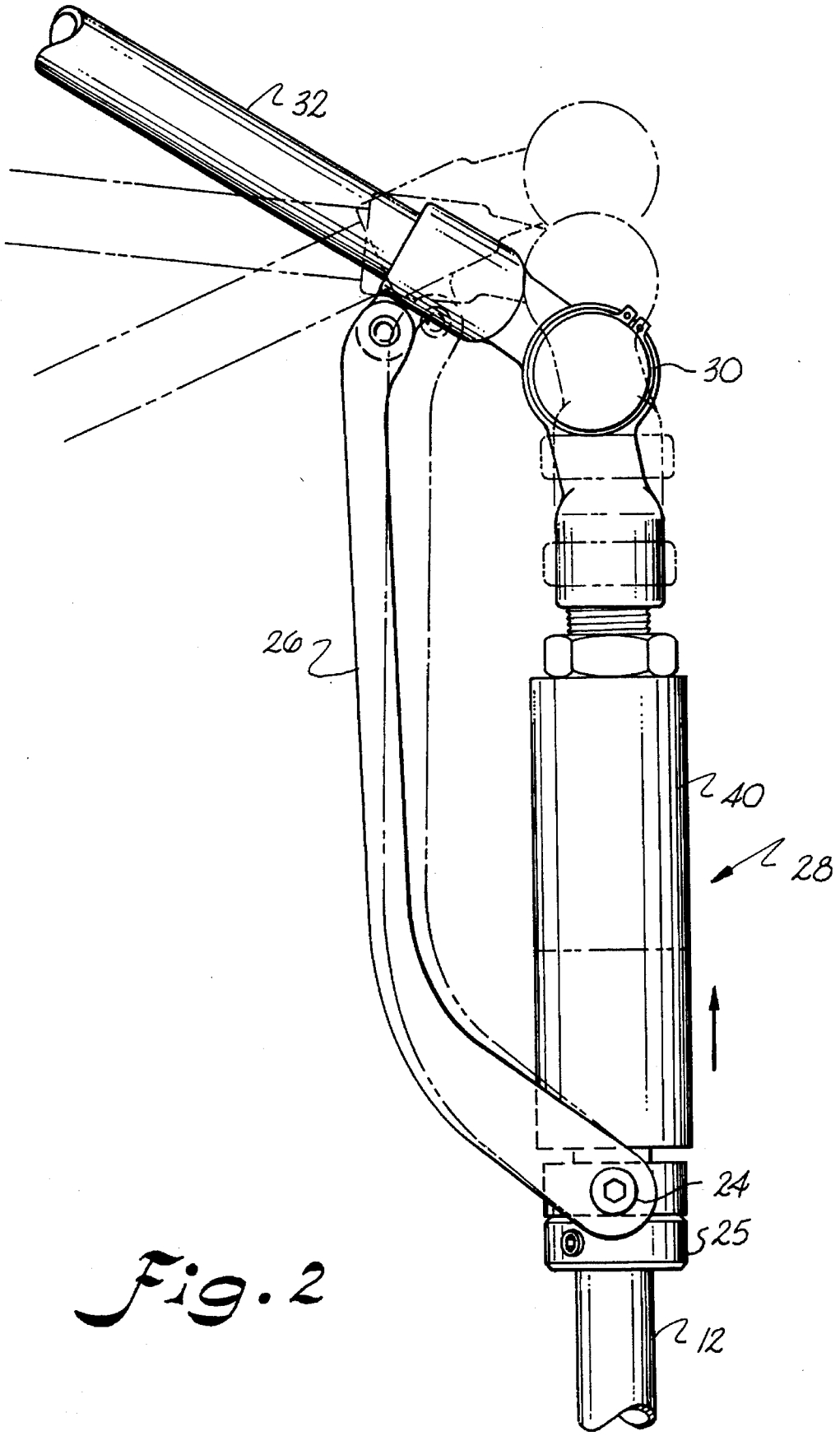
FIG. 2 is an enlarged perspective view of the swivel actuation valve shown in FIG. 1 particularly illustrating the axial displacement characteristics of the valve components, as well as the articulation characteristics of the fluid conducting pipe members.

In accordance with the present invention, and as shown generally in FIGS. 1 and 2, a swivel actuation valve 28 for use with a pull-down actuated rinsing assembly or pre-rinse unit 10 is provided. Pre-rinse or rinsing assemblies 10 are generally known in the art and a detailed description of these devices is not necessary. Generally though, unit 10 includes a riser pipe 12 which is connectable to a source of fluid, such as a conventional plumbing supply, etc. An intermediate pipe member 32 is articulately connected to the riser pipe 12 through, for example, pivotable fluid conducting knuckle 30. Arm 32 is also pivotable or rotatable relative riser pipe 12. A flexible arm member 36 is also generally provided connected to intermediate member 32 also through a pivotable knuckle 34. Arm 36 includes a spray head attached thereto. Spray head 38 preferably includes a gripping portion 39 which provides an easily accessible grip for an operator to grasp the spray head. A connecting link or arm 26 is provided between intermediate pipe 32 and riser pipe 12. Connecting arm 26 may be connected at one end to knuckle 30 and, at the other end, to riser pipe 12. Arm 26 may be attached to riser pipe 12 through, for example, cap screw 24 and collar 25. Pipe 32 is biased away from riser pipe 12 by way of a spring housed in an actuation valve 28, as will be explained more fully below.

Figure 3:
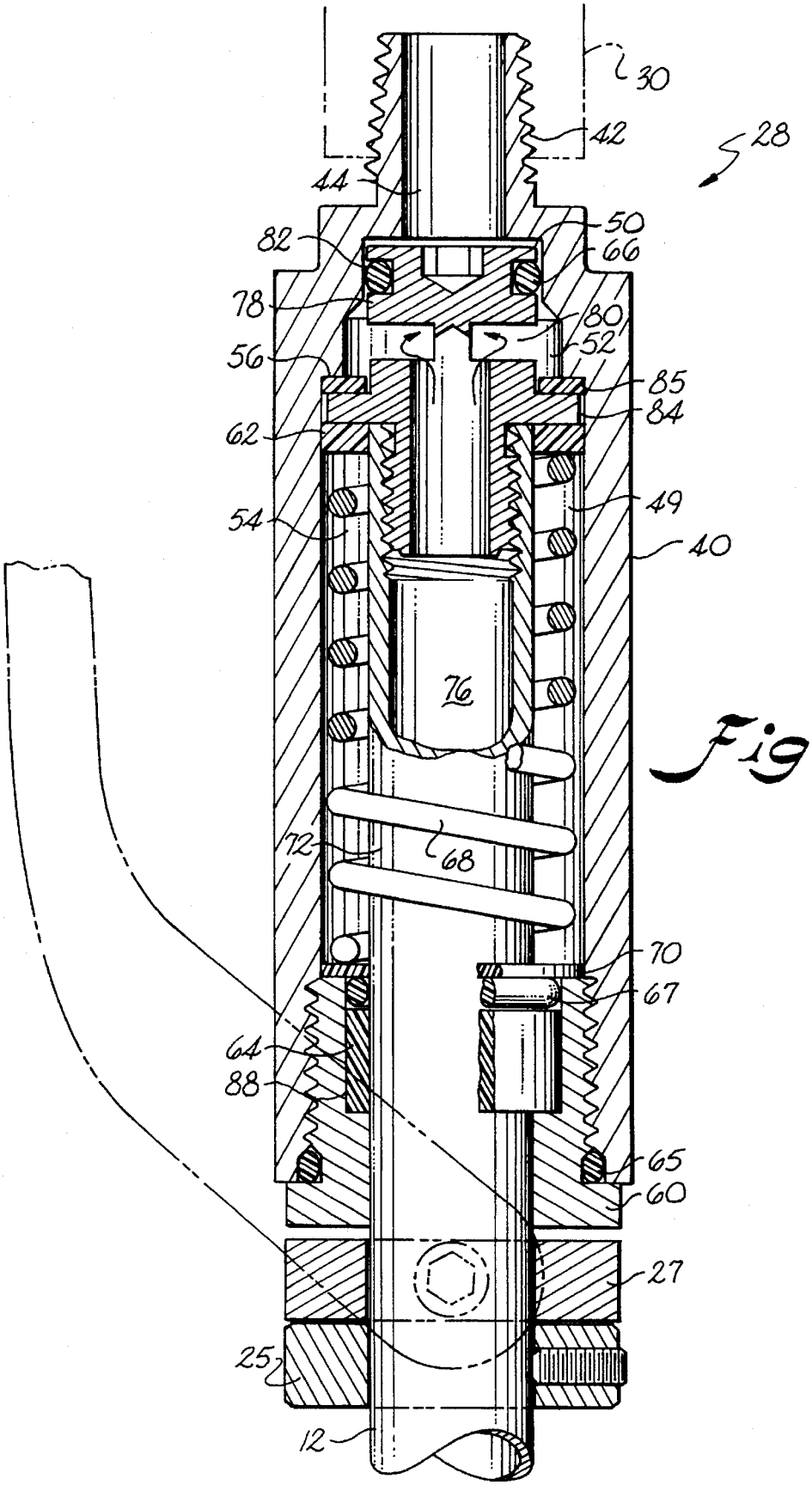
FIG. 3 is a cross-sectional view of the swivel action valve according to the invention shown in its closed axial position.

The actuation valve 28 according to the present invention is engaged at one end with knuckle 30, and at the other end with riser pipe 12, or may comprise a section of riser pipe 12 itself, as shown in FIG. 3. Preferably, a threaded engagement exist between the parts to facilitate easy removal and replacement. However, it is within the scope of the invention to include any conventional engaging means, such as a snap fit or similar mechanical mechanism. Additionally, the components may be permanently engaged, such as through glue, or the like.

Figure 4:
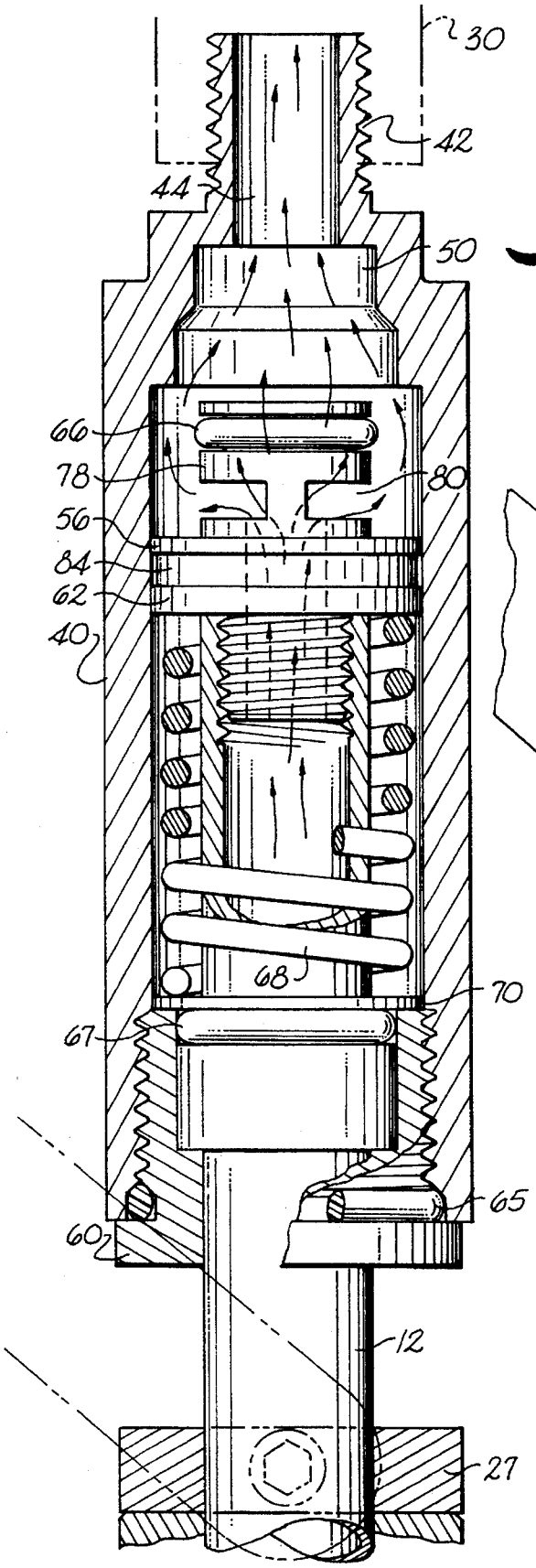
FIG. 4 is a cross-sectional view of the swivel valve shown in FIG. 3 in its open axial position with the internal fluid path being illustrated by pointed lines.

FIG. 2 provides a more detailed and functional view of the relationship between pipe member 32, knuckle 30, actuation valve 28, and the riser pipe 12. As can be clearly seen from FIG. 2, the end of actuation valve 28 is in communication with riser pipe 12, which is axially stationary. For example, actuation valve 28 may be threadedly engaged with riser pipe 12 as shown in FIG. 4, or riser pipe 12 may actually extend into and comprise a portion of actuation valve 28. The dotted lines of FIG. 2 indicate the configuration wherein assembly 10 is being actuated by a downward force being applied to arm 32 through, for example, an operator pulling on flexible arm 36. The other end of actuation valve 28 is threadedly engaged to knuckle 30. As will be explained more fully below, valve 28 includes axially displaceable outer sleeve member 40 which is secured to knuckle 30. Downward motion of arm 32 causes knuckle 30 to be displaced axially upward. This action in turn pulls outer sleeve member 40 away from riser pipe 12 since arm 26 is fixed to stationary riser pipe 12. Thus, this action pulls apart the members of actuation valve 28 from a closed axial position to an open axial position. Hence, by merely pulling down on spray valve 38, an operator actuates assembly 10 through actuation valve 28.

Referring to FIGS. 3 and 4, the operation and construction of actuation valve 28 will be described in detail. FIG. 3 illustrates actuation valve 28 in a closed relative position. Valve 28 includes an outer sleeve body or member 40. Outer sleeve member 40 includes an internal cavity, generally 49. In the embodiment illustrated, internal cavity 49 includes a first section 50 defining a first inner diameter. Internal cavity 49 includes a second section 52 having a second inner diameter which is greater than the inner diameter of first section 50. Cavity 49 may also include a third section, 54 having a third inner diameter which is greater than the diameter of second section 52. It should be understood, however, that the internal configuration of cavity 49 can assume any manner or number of shapes and dimensions which would satisfy the operational requirements of the valve. All such internal configurations are within the scope and spirit of the invention.

Outer sleeve member 40 also includes a threaded extension 42 having a fluid path 44 defined therethrough. Fluid path 44 is in fluid communication with internal cavity 49. Threaded extension 42 may be considered as the discharge end of valve 28. Outer body member 40 may preferably also include a threaded receiving portion 70 defined on at least a portion of its inner diameter within internal cavity 49. Valve 28 may include a threaded end cap 60 which is threadedly engaged with receiving end 74 of outer body member 40. This arrangement is preferred in that it allows for relatively easy assembly and disassembly of valve 28 for replacement of wear components. However, it should be understood that end cap 60, or the structural equivalent thereof, could be integrally formed with outer member body 40, or comprise a molded or cast portion thereof.

Figure 5:
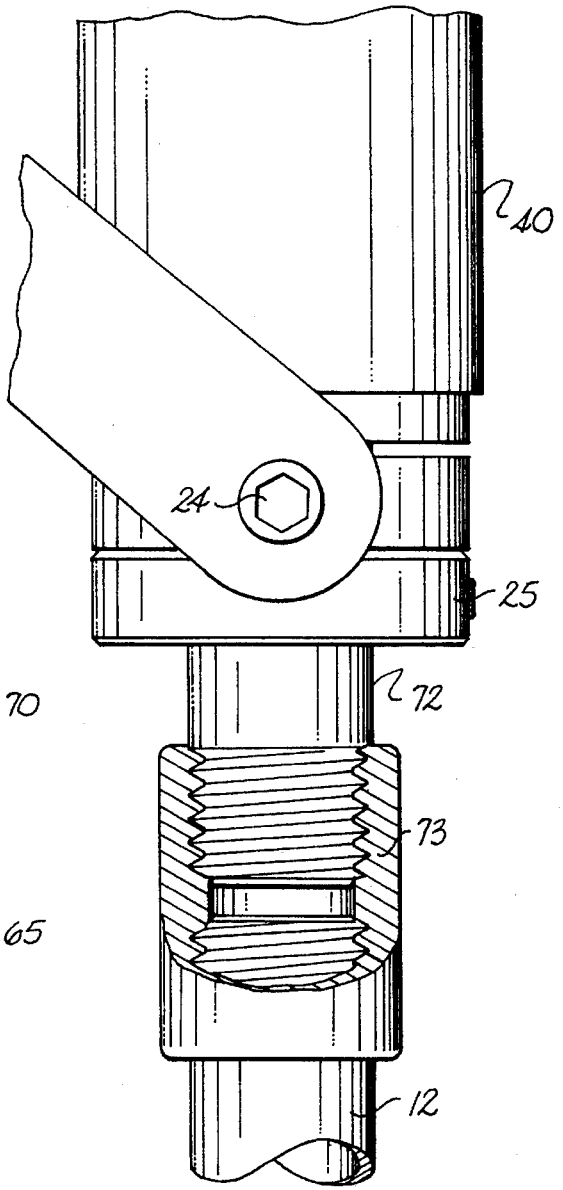
FIG. 5 is a partial cross-sectional view of an alternative embodiment of the invention particularly illustrating the connection with the rinsing assembly riser pipe.

Valve 28 further includes an inner fluid conducting member or inner body member, generally 72. Inner body member 72 is disposed within internal cavity 49 and coaxial with outer body member 40. Inner body member 72 may comprise a section of riser pipe 12 (FIG. 3), or may comprise a separate pipe component threadedly engaged with riser pipe 12 (FIG. 5). A space is defined within internal cavity 49 between at least a portion of inner body member 72 and outer member 40. Inner body member 72 may include a threaded receiving end 74 for threaded engagement with riser pipe 12. A fluid path or bore 76 is defined through inner member 74 and is open at its discharge end into internal cavity 49. In the preferred embodiment illustrated in the figures, fluid path 76 through internal body member 72 opens into second internal section 52 of outer body member 40. In a preferred embodiment, at least one, and preferably two, discharge ports 80 are defined at an angle, preferably substantially perpendicular, to the axis of inner body member 72 so that the fluid path into internal cavity 49 is as indicated by the pointed lines in FIG. 3. It should be understood, however, that any configuration of the discharge end of inner body member 72 is within the scope and spirit of the invention. For example, instead of ports 80, circumferential holes or the like could be defined in discharge end 78 of inner body member 72. Any number of configurations would suffice in the present invention, and all are within the scope and spirit of the invention.

Inner body member 72 also includes a section or end 78 which engages or slides within first section 50 of outer body member 40. A sealing means or device 66 is operably disposed between inner body member 72 and outer body member 40 so as to seal internal cavity 49 from extension fluid path 44 when the inner and outer body members are in a closed axial relative position. As can be seen in FIG. 3, fluid discharged through ports 80 is unable to exit valve 28 in the closed axial relative position of the body members since sealing device 66 and inner body member 72 close or seal fluid communication from internal cavity 49 out of valve 28. Additionally, as shown in FIG. 3, the upper portion of inner body member 72 which defines ports 80 and end 78 may comprise a component 79 which is threadedly engaged with riser pipe 12.

FIG. 3 illustrates a preferred embodiment wherein sealing device 66 resides within a circumferential groove 82 defined in end member 78. In this regard, sealing device 66 is axially stationary relative to outer body member 40. However, it should be understood that sealing device 66 could be axially stationary relative to inner body member 72 if carried in a groove defined in outer body member 40. Additionally, sealing device 66 may encompass any manner of conventional sealing devices, such as 0-rings, or the like. Any number of conventional sealing devices may be used in the invention and are within the scope and spirit of the invention.

A first bearing device or means 62 is provided disposed between the outer body member 40 and inner body member 72. Bearing device 62 may comprise any manner of conventional bearing devices, such as teflon rings, snap rings, ball bearings, or the like. Bearing device 62 allows for rotational movement between outer body member 40 and inner body member 72, as well as axial movement therebetween. In the embodiment illustrated in the figures, bearing device 62 resides against a stop 84 defined on inner body member 72. A thrust bearing 85 may be placed between stop 84 and a shoulder 56 of outer sleeve 40. However, it should be understood that device 62 could reside within a circumferential groove defined in outer body member 40 or defined in inner body member 72.

In a preferred embodiment of the invention, a second bearing device 64 is provided disposed within a second bearing device groove 88 defined in end cap 60. The bearing devices co-operate to maintain the axial alignment between the inner and outer body members and to facilitate axial displacement therebetween while preventing binding of the members. An additional sealing device 67 is disposed above bearing 64 about member 72 and below a spring seat 70.

The sealing devices 66 and 67 serve, on the one hand, to prevent passage of liquid through valve 28 when the body members are in the closed relative position, and also to prevent leakage of fluid from internal cavity 49. Preferably, the sealing devices are of the same size, or at least present the same surface area to fluid within internal cavity 49, so that opposing axial forces within valve 28 caused by pressurized fluid within cavity 49 will be substantially equal and will not bias the valve to an opened or closed position. Thus, the only biasing force between the body members is caused by the resilient biasing means regardless of fluid pressure within the valve.

In the embodiment wherein a removable end cap 60 is provided, a third sealing ring 65 may be provided between the outer body member 40 and end cap 60, as seen in FIGS. 3 and 4.

Valve 28 further includes resilient biasing means disposed relative to outer body member 40 and inner body member 72 for biasing the body members to their closed relative position, as seen in FIGS. 3 and 4. The resilient biasing means preferably includes a spring 68 co-axially disposed within cavity 49 between inner body member 72 and outer body member 40. The spring is pre-stressed so as to bias the body members to their closed position. In the embodiment illustrated in the figures, spring 68 is pre-stressed between a spring seat 70 which is disposed atop of end cap 60 and first bearing device 62. However, it should be understood, that spring 68 could be pre-stressed between any appropriate structural stops or seats. Since one end of the spring is seated against a surface which is axially stationary relative to inner body member 72 and stationary riser pipe 12, and the other end of spring 68 is seated against a surface which axially moves with outer body member 40, it should be understood that spring 68 forces outer body member 40 axially downward relative inner body member 72 so that the members assume their closed relative axial position.

It should be understood that the embodiment of swivel actuation valve 28 described herein is but a preferred embodiment of the invention and countless configurations and modifications can be made to the structure of the valve without departing from the scope and spirit of the appended claims. For example, the internal cavity 49 of outer body member 40 need not have 3 distinct sections as described herein, but could be defined as any cavity which allows sealing member or O-ring 66 to be displaced from a first position relative outer body member 40 wherein its seals against outer body member 40, or another surface which is substantially integral with outer body member 40, to a second relative axially position wherein O-ring 66 no longer seals the internal fluid path through the valve. Additionally, the arrangement of swivel spring 68 between bearing devices 62 and valve seat 70 is but a mere example of any number of suitable configurations. For example, spring 68 could be seated between spring seats formed integral with the respective body members. Also, instead of a single swivel spring 68, individual springs could be disposed within axial chambers defined within outer body member 40. Any number or manner of resilient biasing means may be disposed relative the outer sleeve member and inner body fluid conducting member for biasing the members to the relative axially closed position.

FIG. 4 shows the swivel actuation valve 28 according to the invention in its open position. The valve is opened by an operator pulling down on spray head 38 or gripping portion 39 (FIG. 1). As illustrated in FIG. 2, this action causes knuckle 30 to be displaced essentially upwards through the motion of connecting arm member 26. Connecting arm member 26 is axially stationary relative to riser pipe 12, as illustrated in FIG. 2. The upward motion of knuckle 30 pulls outer sleeve member 40 axially upwards against biasing spring 68. The upward motion of outer sleeve 40 causes head portion 78 and sealing device 66 to be axially displaced from first section 50 of internal cavity 49. Once sealing device 66 disengages from the surface of first section 50, fluid is free to exit the valve through discharge fluid path 44. At any time during operation of the valve, outer sleeve member 40 can be rotated relative to inner body member 72 by way of the operator merely swinging or rotating spray head 38. In this manner, the entire rinsing assembly provides broad coverage over theoretically 360°. Connecting arm 26 is fixed relative to riser pipe 12 through a collar 27 which is rotatable about riser pipe 12. Collar 27 may be fixed in place by way of a separate collar 25 or other suitable means. In this manner, connecting arm 26 is rotatable about riser pipe 12 and can actuate valve 28 in any position.

Upon release of the spray head 38 or gripping portion 39, valve 28 is forced to its closed position by way of biasing spring 68. Spring 68 forces head portion 78 and sealing member or device 66 back into first section 50 thereby sealing fluid discharge path 44 from internal cavity 49.

FIG. 5 shows an alternative embodiment of the invention wherein inner body member 72 comprises a separate pipe section which is threadedly engaged with riser pipe 12 through, for example, a collar 73. It should be understood that inner body member 72 could be threaded directly into riser pipe 12. In this embodiment, head portion 78 would be formed directly in the pipe section of inner body member 72, as compared to the embodiment of, for example, FIG. 4 wherein riser pipe section 12 extends into the valve with head portion 78 comprising a component threadedly engaged with riser pipe 12.

It should also be understood that the appended claims drawn to the swivel actuation valve are not limited to such a valve in a pre-rinse or rinsing assembly as described herein. The inventive swivel actuation valve can be incorporated and retro-fitted into any manner of plumbing systems or fixtures wherein actuation of the fluid conducting operation is dependent upon axial movement between the body parts of the valve. It will be apparent to those skilled in the art that various modifications and variations can be made in the apparatus of the present invention without departing from the scope or spirit of the invention. Thus, it is intended that the present invention cover the modifications and variations of this invention provided they come within the scope of the appended claims and their equivalents.

What is claimed is:

1. An actuation valve for conducting fluid between opposing pipe members, said valve comprising:

an outer body member mateable with a first conducting pipe member;

an inner body member mateable with a second conducting pipe member, said inner body member disposed co-axially within said outer body member, said outer body member being axially moveable relative said inner body member;

an internal fluid path defined between said inner body member and said outer body member, said internal fluid path being sealed when said inner and outer body members are in a first relative axial position and being open when said inner and outer body members are in a second relative axial position;

internal biasing means for biasing said inner and outer body members towards said first relative axial position; and at least one bearing device disposed between said inner and outer body members so that said inner and outer body members are rotatable relative each other.

2. The valve as in claim 1, further comprising a first sealing device disposed between said inner and outer body members so as to seal said internal fluid path in said first relative axial position and a second sealing device disposed between said inner and outer body members so as to prevent leakage of fluid from between said inner and outer body members, said sealing devices presenting generally equal surface areas to internal fluid pressure within said valve.

3. A swivel actuation valve for use with a pull-type actuated fluid conducting assembly, said valve comprising:

an outer sleeve member, said outer sleeve member defining an internal cavity and an outlet in fluid communication with said cavity and mateable with a fluid conducting arm of the assembly;

an inner fluid conducting member disposed substantially within said internal cavity and coaxial with said outer sleeve member, said inner fluid conducting member having a discharge end open to said cavity;

said outer sleeve member being axially moveable relative said inner fluid conducting member between a closed relative position and an open relative position, in said open relative position an internal fluid path is defined between said discharge end and said outer sleeve member outlet;

first bearing means disposed between said outer sleeve member and said inner fluid conducting member for allowing relative rotational movement therebetween;

first sealing means disposed between said outer sleeve member and said inner fluid conducting member for sealing said internal fluid path in said closed relative position; and resilient biasing means disposed relative said outer sleeve member and said inner fluid conducting member for biasing said outer sleeve member and said inner fluid conducting member to said closed position.

4. The valve as in claim 3, further comprising an end cap releasably engaged with said outer sleeve member so as to rotate therewith relative said inner fluid conducting member, and second bearing means disposed between said end cap and said inner fluid conducting member for allowing relative rotational movement therebetween.

5. The valve as in claim 4, wherein said end cap comprises a threaded extension engageable with a threaded receiving end of said outer sleeve member, and further comprising second sealing means disposed between said threaded extension and said inner fluid conducting member for preventing leakage of fluid from said internal cavity.

6. The valve as in claim 5, wherein said first sealing means and said second sealing means comprise generally equal surface areas presented to fluid within said internal cavity so that fluid pressure within said internal cavity will not bind axial movement between said outer sleeve member and said inner fluid conducting member.

7. The valve as in claim 4, wherein said first bearing means comprises a bearing ring disposed around said inner fluid conducting member and said second bearing means comprises a bearing ring disposed within a circumferential groove defined in said end cap, said resilient biasing means disposed between said first and second bearing rings.

8. The valve as in claim 3, wherein said resilient biasing means comprises a spring disposed between said outer sleeve member and said inner fluid conducting member, said spring pre-stressed so as to axially force apart said outer sleeve member and said inner fluid conducting member to said closed relative position.

9. The valve as in claim 8, wherein said spring is pre-stressed between a stop secured relative said inner fluid conducting member and a spring seat secured relative said outer sleeve member.

10. The valve as in claim 3, wherein said discharge end of said inner fluid conducting member comprises at least one fluid discharge port oriented substantially perpendicular to the axis of said inner fluid conducting member.

11. The valve as in claim 10, wherein said outer sleeve member internal cavity includes a first section having a first inner diameter and a second section having a second inner diameter greater than said first inner diameter, said first sealing means comprising a resilient sealing ring disposed about said inner fluid conducting member and sealing against said first section inner diameter, said discharge port being open to said second section, said internal fluid path being defined when said resilient sealing ring is axially displaced to said second section by movement of said outer sleeve member relative said inner fluid conducting member.

12. The valve as in claim 11, wherein said internal cavity includes a third section having a third inner diameter greater than said second inner diameter, said resilient biasing means comprising a spring disposed within said third section.

13. The valve as in claim 3, wherein said first bearing means comprises a bearing ring disposed around said inner fluid conducting member adjacent a stop defined in said inner fluid conducting member.

14. A rinsing assembly, comprising:

a riser pipe member connectable to a fluid source;

a second pipe member articulately configured in fluid communication with said riser pipe member, said second pipe member being pivotable relative said riser pipe member;

a swivel actuation valve operably disposed between said riser pipe member and said second pipe member, said swivel actuation valve further comprising:

an outer body member, and an inner body member disposed co-axially within said outer body member, at least one of said inner body member and said outer body member being axially moveable relative each other;

a sealable internal fluid path defined through said inner body member and said outer body member, said internal fluid path being sealed when said inner and outer body members are in a first relative axial position and being open when said inner and outer body members are in a second relative axial position so that fluid can be conducted from said riser pipe member to said second pipe member;

internal biasing means for axially biasing said inner and outer body members towards said first relative axial position; and at least one bearing device disposed between said inner and outer body members so that said inner and outer body members are rotatable relative each other; and said rinsing assembly further comprising a connecting mechanism operably disposed between said second pipe member and said riser pipe member so that downward force on said second pipe member actuates said swivel actuation valve by forcing said outer body member against said internal biasing means to said second relative axial position.

15. The rinsing assembly as in claim 14, further comprising a third pipe member articulately configured in fluid communication with said second pipe member.

16. The rinsing assembly as in claim 15, further comprising a spray head operably configured with said third pipe member, said spray head including a gripping portion whereby an operator can actuate said rinsing assembly by grasping said gripping portion and pulling said third pipe member downward.

17. The rinsing assembly as in claim 16, wherein said third pipe member comprises a flexible hose.

18. The rinsing assembly as in claim 14, further comprising a, pivotal fluid conducting knuckle disposed between said riser pipe member and said second pipe member, said outer body member is threadedly engaged with said fluid conducting knuckle and said inner body member is threadedly engageable with said riser pipe member.

19. The rinsing assembly as in claim 14, wherein said outer body member defines an internal cavity having a first section with a first inner diameter and a second section with a second inner diameter greater than said first inner diameter, said inner body member being disposed co-axially within said internal cavity, and further including a first seal member disposed between said inner and outer body members, in said first relative axial position of said inner and outer body members said seal member seals against said inner diameter of said first section and in said second relative axial position of said inner and outer body members said seal member is axially displaced to said second section thereby unsealing said internal fluid path.

20. The rinsing assembly as in claim 10, wherein said internal biasing means comprises a spring disposed co-axially between said inner and outer body members, said spring pre-stressed between opposing stops so as to bias said inner and outer body members towards said first relative axial position.

21. The rinsing assembly as in claim 21, further comprising a second seal member disposed within said outer body member internal cavity between said inner and outer body members, said second seal member axially displaced from said first seal member, said first and second seal members having relatively equal surface areas which are presented to internal fluid pressure within said swivel valve.

22. The rinsing assembly as in claim 21, wherein said internal biasing means comprises a spring disposed co-axially between said inner and outer body members, said spring pre-stressed between opposing stops so as to bias said inner and outer body members towards said first relative axial position, said spring disposed between said first and second seal members.

23. The rinsing assembly as in claim 19, wherein said inner body member includes at least one discharge port disposed substantially perpendicular to the axis of said inner body member, said discharge port opening into said outer body member internal cavity.

* * * * *

UNITED STATES PATENT AND TRADEMARK OFFICE

CERTIFICATE OF CORRECTION

PATENT NO. : 5,492,148

DATED : FEBRUARY 20, 1996

INVENTOR(S) : GOUGHNEOUR ET AL.

It is certified that error appears in the above-indentified patent and that said Letters Patent is hereby corrected as shown below:

Claim 20, line 1, please delete "10" and substitute therefor --19--.

Claim 21, line 1, please delete "21" and substitute therefor --19--.

Signed and Sealed this

Thirtieth Day of November, 1999

*Attest:*

*Attesting Officer*

Q. TODD DICKINSON

*Acting Commissioner of Patents and Trademarks*